US010767646B2

(12) United States Patent
Tekneyan et al.

(10) Patent No.: US 10,767,646 B2
(45) Date of Patent: Sep. 8, 2020

(54) PUMP HOUSING FOR AN ECCENTRIC SCREW PUMP AND AN ECCENTRIC SCREW PUMP EQUIPPED THEREWITH

(71) Applicant: NETZSCH Pumpen & Systeme GmbH, Selb (DE)

(72) Inventors: Mikael Tekneyan, Kraiburg am Inn (DE); Philipp Nübl, Gras Bahnhof (DE); Magdalena Brüning, Mettenheim (DE)

(73) Assignee: NETZSCH Pumpen & Systeme GmbH, Selb (DE)

( * ) Notice: Subject to any disclaimer, the term of this patent is extended or adjusted under 35 U.S.C. 154(b) by 293 days.

(21) Appl. No.: 15/735,878

(22) PCT Filed: Jun. 9, 2016

(86) PCT No.: PCT/DE2016/000240
§ 371 (c)(1),
(2) Date: Dec. 12, 2017

(87) PCT Pub. No.: WO2016/198037
PCT Pub. Date: Dec. 15, 2016

(65) Prior Publication Data

US 2018/0252211 A1 Sep. 6, 2018

(30) Foreign Application Priority Data

Jun. 12, 2015 (DE) ..... 10 2015 007 521

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/107*** | (2006.01) |
| ***F01C 21/10*** | (2006.01) |

(52) U.S. Cl.
CPC ..... *F04C 2/1075* (2013.01); *F01C 21/106* (2013.01); *F04C 2/1071* (2013.01); *F04C 2230/70* (2013.01)

(58) Field of Classification Search
CPC .. F04C 2/1071; F04C 2/1075; F04C 2230/70; F01C 21/106; F16D 3/16; F16D 3/2237
USPC ..... 418/48, 152–153
See application file for complete search history.

(56) References Cited

U.S. PATENT DOCUMENTS 3,804,561 A 4/1974 Kramer
5,688,114 A 11/1997 Millington et al.

FOREIGN PATENT DOCUMENTS

DE 102008021919 A1 11/2009
EP 2205872 A2 7/2010

OTHER PUBLICATIONS

International Search Report & Written Opinion of the International Searching Authority Application No. PCT/DE2016/000240 completed Date: Oct. 7, 2016; dated Oct. 17, 2016 10 pages.

*Primary Examiner* — Theresa Trieu
(74) *Attorney, Agent, or Firm* — Whitmyer IP Group LLC

(57) ABSTRACT

A pump housing for an eccentric screw pump, with a longitudinal axis and a hollow space constituted running axially between a drive-side opening and a pump-side opening, wherein the pump-side opening is enclosed by a main housing body and a lid fastened removably thereto, wherein the main housing body includes a ring segment-shaped axial guiding surface lying opposite the lid.

18 Claims, 3 Drawing Sheets

PUMP HOUSING FOR AN ECCENTRIC SCREW PUMP AND AN ECCENTRIC SCREW PUMP EQUIPPED THEREWITH

TECHNICAL FIELD

The invention relates to a pump housing for an eccentric screw pump and an eccentric screw pump with such a pump housing.

BACKGROUND

An eccentric screw pump is known from document DE102008021919 AI. Another solution is known from document EP2 205 872 B1.

The problem underlying the invention is to provide a pump housing for an eccentric screw pump, which enables easy access to the housing interior and easy dismantling of the eccentric screw pump arrangement.

SUMMARY

According to the invention, the problem is solved by a pump housing for an eccentric screw pump.

As a result of the fact that the main housing body comprises a ring segment-shaped axial guiding surface lying opposite the lid, a stator flange element complementary to the guiding surface, in particular its sealing flange, can be guided in an axially displaceable manner by the main housing body. "Lying opposite the lid" means on the other side of a horizontal plane enclosing the longitudinal axis of the pump housing, and "ring segment-shaped" means a ring segment-shaped surface with a predetermined radius around the longitudinal axis. The guiding surface is preferably located in the lower half of the main housing body, in particular inside at the bottom of the main housing body. It is thus ensured that the stator flange element guided displaceably on the guiding surface can be removed radially upwards through the lid opening in the main housing body.

Furthermore, the axial guiding surface preferably runs only in a region of the main housing body covered by the lid, since processing of the guiding surface is thus easier in the lid opening region during the production of the main housing body. The region covered by the lid is to be understood to mean a projection of the lid perpendicular to the longitudinal axis on the main housing body.

Moreover, the lid is preferably provided with a ring segment-shaped inner circumferential surface lying opposite the guiding surface, which inner circumferential surface has the same distance radially from the longitudinal axis as the guiding surface and is bounded axially on the inside by a projection of the lid which extends radially inwards and which is preferably located opposite the guiding surface. The opposite-lying, ring segment-shaped inner circumferential surface, which has the same distance radially from the longitudinal axis as the guiding surface, forms together with the guiding surface a closed annular surface, which serves to receive the sealing flange of a complementary, circular stator flange element, which lies preferably with an O-ring fluid-tight on such an annular surface, in order to seal the hollow space of the pump housing to the exterior. As a result of the described lid projection towards the longitudinal axis, which is preferably located opposite the guiding surface of the main housing body and which preferably axially bounds the inner circumferential surface of the lid, in such a way that the guiding surface of the main housing body extends farther towards the drive side of the main housing body than the inner circumferential surface, a stator flange element lying on the guiding surface and on the inner circumferential surface is prevented by means of the lid projection, when the lid is fastened to the housing body, from being displaced in the direction of the drive-side opening. The guiding surface is advantageously at least twice as long axially as the ring segment-shaped inner circumferential surface, since it can thus be reliably ascertained whether a stator flange element is in a position displaced in the direction of the drive-side opening, in which position the fastening of the lid to the main housing body should not take place.

An advantageous development makes provision such that the guiding surface is bounded axially on the outside by a radial projection of the main housing body. The effect of such a projection is that a stator flange element guided on the guiding surface cannot be pushed axially out of the main housing body, and at the same it time represents a positioning stop, which fixes the correct installation position of a subassembly comprising rotor, stator and stator flange element. Moreover, the guiding surface is advantageously interrupted by a fixing projection projecting inwards in a stepwise manner, which divides the guiding surface into a pump-side holding region and a drive-side guiding region, wherein the holding region extends between the positioning stop and the fixing projection in the form of a groove in the circumferential direction, in such a way that the sealing flange of the stator flange element can be placed therein preferably fitting in a form-fit manner, in order to fix the stator flange element axially both in the pump-side direction and also in the drive-side direction. An axially pump-side edge of the fixing projection is advantageously aligned with an axially pump-side edge of the lid projection in a plane perpendicular to the longitudinal axis. A stator flange element collar (sealing flange) introduced into the holding region of the guiding surface is thus secured by the lid and the main housing body against displacement in the drive-side direction of the pump housing.

Moreover, it is advantageous if a contact plane runs between the lid and the main housing body obliquely with respect to the longitudinal axis of the pump housing. This enables easier production and assembly of the lid and a better seal between the lid and the main housing body on account of the possibility of using a flat sealing element. The main housing body advantageously comprises a recess, which is provided for receiving a flat sealing element and which prevents the seal from slipping or falling during the lid assembly.

In an advantageous embodiment, provision is made such that a stator flange element capable of being coupled with the pump housing is axially displaceable on the guiding surface and the lid fastened to the main housing body prevents a displacement of the stator flange element in the direction of the drive-side opening. The pump housing and the stator flange element can form a pump housing subassembly, which can then be installed in an existing eccentric screw pump. Such a structure also offers protection of the stator flange element against rattling during transport of the pump housing with the assembled lid. Furthermore, assembly errors can be avoided, since the lid first has to be removed before the stator flange element can be moved in the direction of the drive-side opening of the pump housing, so that the axial overall length of the pump housing subassembly can be reduced for installation in an existing eccentric screw pump. The stator flange element preferably comprises a hollow cylinder, which has a radial guide collar at its one, drive-side end, which can be constituted as a sealing flange, and a radial stator flange collar at its other, pump-side end, wherein the stator flange element lies with its guide collar on the guiding surface and the stator flange collar is spaced apart from the pump-side opening to the exterior and can be brought into an operative connection with a stator. The stator flange collar advantageously prevents the stator flange element from being completely displaceable into the main housing body when the lid is removed. The axial displaceability of the stator flange element is thus limited when the lid is dismantled, so that correct positioning of the stator flange element in the main housing body can more easily be brought about before fastening of the lid to the main housing body. The guide collar of the stator flange element preferably comprises a bevel, which is complementary to a bevel of the projection of the lid extending radially inwards, so that, with an advancing approach of the lid towards the main housing body during the fastening thereof to one another, the stator flange element positioned in between is displaced axially in the direction opposite to the rotor-side opening of the pump housing and is secured against travelling back.

It is also advantageous that the main housing body, as described, limits the axial displaceability of the stator flange element in a direction away from the drive-side opening, as a result of which axial falling-out of the stator flange element from the pump housing is prevented. At least one of the already described positioning or fixing projections is advantageously present for this purpose.

The initially mentioned problem is also solved by an eccentric screw pump.

As a result of the fact that the stator flange element is arranged between the stator and the pump housing such that, in the fastened state of the lid, it fixes a stator end in a complementary stator holder of the connecting piece, the stator cannot be removed from the eccentric screw pump when the lid is fastened, i.e. the lid fixes the stator in its final installation position by means of the stator flange element.

It is particularly advantageous that, when the lid is removed, the stator can be axially displaced so far out of the connecting piece in the direction of the pump housing that it disengages from the stator holder of the connecting piece. This enables a space-saving radial removal of the stator from the eccentric screw pump.

The stator, the rotor and the stator flange element advantageously form a subassembly, which can also be supplemented by a coupling element fastened at the drive-side rotor end. The stator, the rotor, the stator flange element, a coupling element fastened at the drive-side rotor end and a pump-side cardan shaft portion adjoining the drive-side end of the coupling element form a subassembly, wherein the pump-side cardan shaft portion is connected detachably to a further drive-side cardan shaft portion, which corresponds to the required axial displacement distance of the subassembly, such that the latter can be removed from the eccentric screw pump; the hollow space of the pump housing and the other components present therein are then accessible for maintenance or assembly and dismantling. The required torque-proof, detachable connection with a sufficient axial displacement distance can also be provided in the coupling element according to the same principle instead of in the cardan shaft. The stator flange element is preferably constituted in one piece with the stator.

BRIEF DESCRIPTION OF THE DRAWINGS

The invention is explained below with the aid of schematic drawings. In the figures.

DETAILED DESCRIPTION

Figure 1:
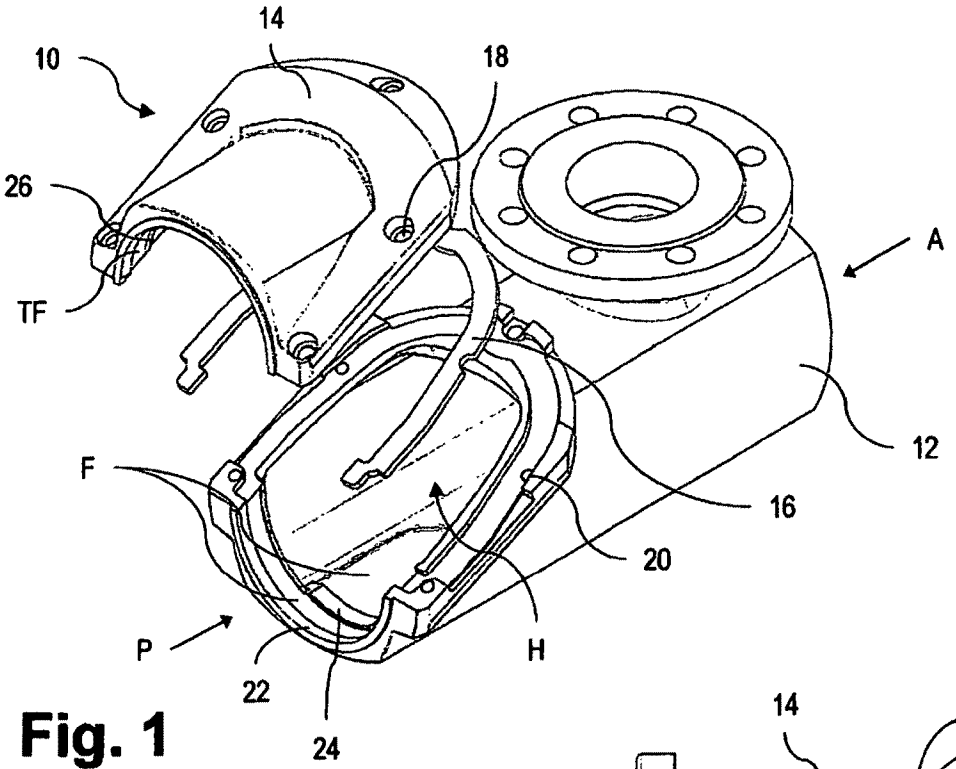
FIG. 1 shows a pump housing according to the invention in a spatially exploded view.
Figure 2:
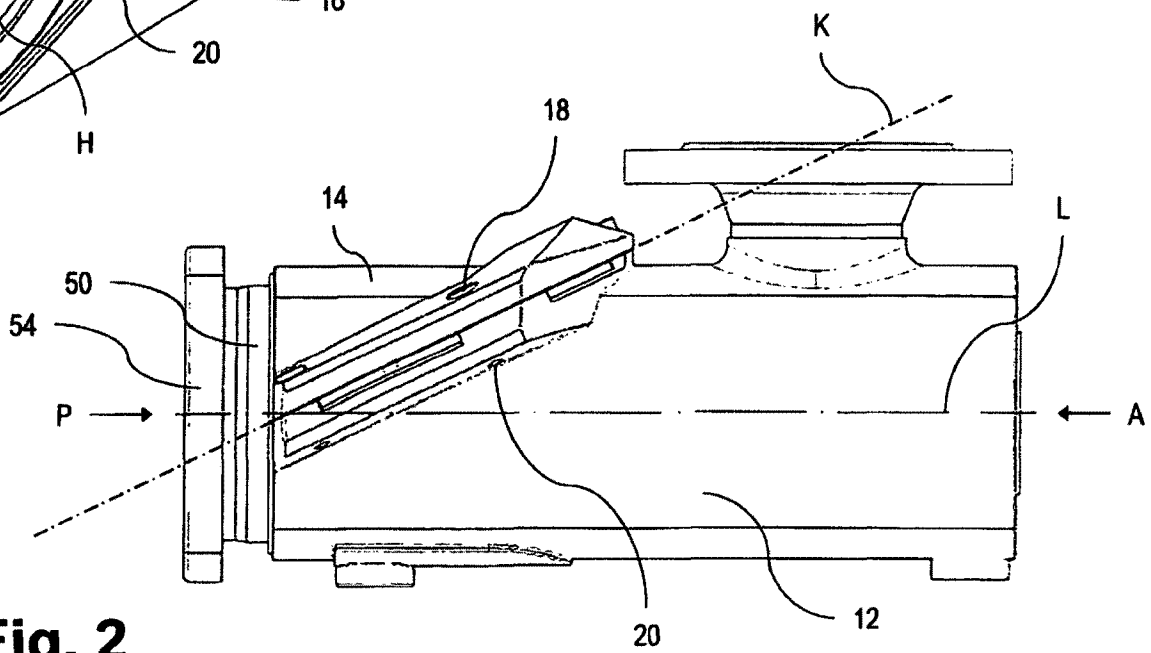
FIG. 2 shows the assembled pump housing from FIG. 1 with a stator flange element in a side view.

FIG. 1 shows a pump housing 10 in a drive train of an eccentric screw pump 100, which comprises a tubular main housing body 12 and a lid 14, which can be fitted thereto, as well as a U-shaped seal 16 arranged between the two. Pump housing 10 has a hollow space H running axially through, which extends between two end-side openings P, A, i.e. between a pump-side opening P and a drive-side opening A. Pump-side opening P is enclosed by main housing body 12 and lid 14 fastened removably thereto. A contact plane K between main housing body 12 and lid 14 runs obliquely with respect to the longitudinal axis of pump housing 10 (FIG. 2). For the fastening of lid 14 to main housing body 12, lid holes 18 and matching main housing holes 20 are provided, into which screws 19 (FIG. 3) are introduced.

In the region of pump-side opening P of pump housing 10, main housing body 12 comprises an ring segment-shaped guiding surface F running axially in the circumferential direction and lying opposite lid 14, which guiding surface extends only in a region of main housing body 12 covered by lid 14. Guiding surface F is bounded axially on the outside by a pump-side projection 22 of main housing body 12. In the example of embodiment from FIG. 1, guiding surface F is interrupted by a fixing projection 24 projecting radially inwards, the purpose of which is described below in further detail. Such a fixing projection 24 is however not essential, so that an uninterrupted guiding surface F can be present.

Lid 14 comprises a ring segment-shaped inner circumferential surface TF lying opposite guiding surface F, which inner circumferential surface is spaced apart radially from longitudinal axis L by the same distance as guiding surface F and is bounded axially on the inside by a drive-side projection 26 in lid 14.

FIG. 2 shows a stator flange element 50 coupled with pump housing 10 from FIG. 1 axially displaceable on guiding surface F, wherein stator flange element 50 can be displaced only when lid 14 is removed. Stator flange element 50 essentially has the shape of a hollow cylinder (FIG. 3), which at its one, drive-side end has a radial guide collar 52 constituted as a sealing flange and at it is other, pump-side end a radial stator flange collar 54, wherein stator flange element 50 lies with its guide collar 52 on guiding surface F and stator flange collar 54 is spaced apart from pump-side opening P to the exterior by pump housing 10. Lid 14 fastened to main housing body 12 prevents a displacement of stator flange element 50 in the direction of drive-side opening A by means of its projection 26. When lid 14 is removed, main housing body 12 with its projection 22 limits the axial displaceability of stator flange element 50 in the opposite direction, in that stator flange collar 54 strikes against projection 22. Main housing body 12 can once again limit the axial displaceability of stator flange element 50 in a direction towards drive-side opening A by means of fixing projection 24. Furthermore, guide collar 52 of stator flange element 50 can comprise a bevel (not shown), which is complementary to a bevel (also not shown) of projection 26 of lid 14 extending radially inwards, so that with an advancing approach of lid 14 towards main housing body 12 when they are being fastened to one another, stator flange element 50 positioned in between the latter is displaced axially in the direction opposite to rotor-side opening A of pump housing 10 and is secured against travelling back.

Figure 3:
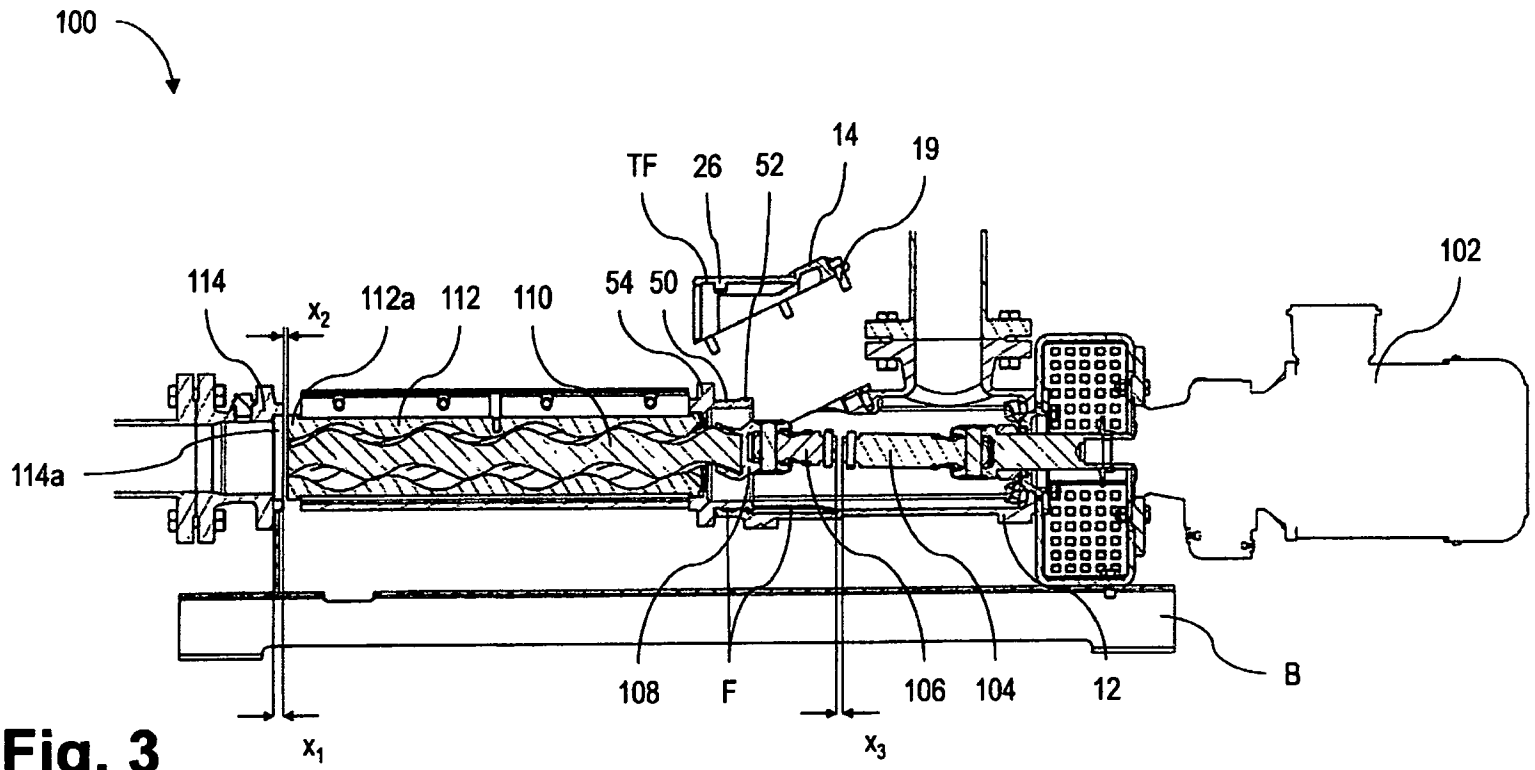
FIG. 3 shows an eccentric screw pump according to the invention with the lid dismantled from the pump housing.
Figure 4:
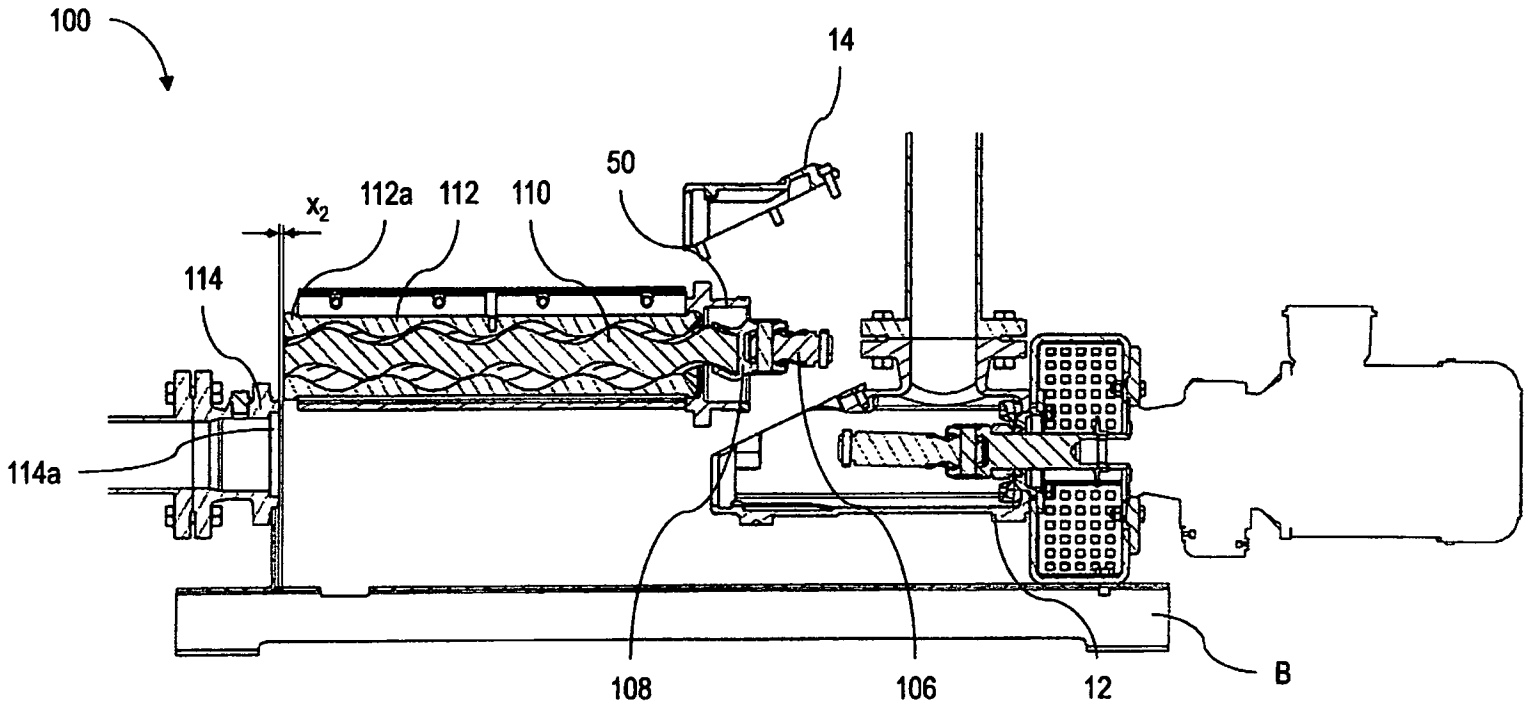
FIG. 4 shows the eccentric screw pump from FIG. 3 with the pump subassembly removed.

FIGS. 3 and 4 show by way of example a dismantling procedure on an eccentric screw pump 100 with a drive unit 102, a two-part cardan shaft adjoining the latter and having a drive-side part 104 and a pump-side part 106, a coupling element 108, a rotor 110, a stator 112 surrounding rotor 110 and having a stator end 112*a*, which fits into a connecting piece 114 with a stator holder 114*a* complementary to stator end 112*a*. Stator flange element 50, which can be constituted in one piece with stator 112, is arranged between stator 112 and pump housing 10, in such a way that, in the fastened state of lid 14, it fixes stator end 112*a* in complementary stator holder 114*a* of connecting piece 114. For this purpose, pump 100 is connected fixedly to a base B in the region of drive unit 102 and connecting piece 114.

FIG. 3 shows in particular a state of eccentric screw pump 100, in which lid 14 of pump housing 10 has already been removed, the torque-proof connection (not represented) of the two cardan shaft parts 104, 106 has been separated through the lid opening in main housing body 12 and the subassembly comprising rotor 110, stator 112, stator flange 50, coupling element 108 and the pump-side part of cardan shaft 106 has already been displaced in the direction of the drive side by a distance x1+x2, wherein x1 is the axial depth of stator holder 114*a* in connecting piece 114 and x2 is a minimum manoeuvring distance from connecting piece 114. In this state, a predetermined distance XJ from drive-side part 104 of the cardan shaft is present. Radial guide collar 52 of stator flange element 50 is first raised over fixing projection 24 during this displacement and then displaced on guiding surface F farther in the direction of drive-side opening A. In an alternative embodiment, no fixing projection 24 is provided and guiding surface F is uninterrupted, so that guide collar 52 of stator flange element 50 can be displaced without being raised. The guiding surface should have a minimum length of x1+x2 and should in any event be longer than x1, in order to enable disengagement of stator end 112*a* from connecting piece 114.

The subassembly is then lifted out, as represented in FIG. 4, from eccentric screw pump 100. This is only possible, because stator flange element 50 and therefore also stator 112 can be displaced axially, when lid 14 is removed, so far out of connecting piece 114 in the direction of pump housing 10 that it can be disengaged from stator holder 114*a* of connecting piece 114. The subassembly capable of being removed in this way can of course also be formed only by stator 112, rotor 110 and stator flange element 50, since a detachable, torque-proof connection is also possible by means of a two-part (not represented) coupling element 108.

The invention claimed is:

1. A pump housing for an eccentric screw pump, with a longitudinal axis and a hollow space constituted running axially between a drive-side opening and a pump-side opening, wherein the pump-side opening is enclosed by a main housing body and a lid fastened removably thereto wherein the main housing body comprises a ring segment-shaped axial guiding surface lying opposite the lid;

wherein the lid includes a ring segment-shaped inner circumferential surface lying opposite the ring segment-shaped axial guiding surface, which the ring segment-shaped inner circumferential surface has the same distance radially from the longitudinal axis as the ring segment-shaped axial guiding surface and is bounded axially on the inside by a projection of the lid extending radially inwards.

2. The pump housing according to claim 1, wherein the ring segment-shaped axial guiding surface extends only in a region of the main housing body covered by the lid.

3. An eccentric screw pump including:

a fixed pump housing with a longitudinal axis and a hollow space constituted running axially between a drive-side opening and a pump-side opening, wherein the pump-side opening is enclosed by a main housing body and a lid fastened removably thereto, wherein the main housing body comprises a ring segment-shaped axial guiding surface lying opposite the lid, a rotor extending out of the pump-side opening of the pump housing, a stator surrounding the rotor and having a stator flange element, and a connecting piece for the stator, which connecting piece is arranged fixedly at the end of the stator facing away from the pump housing, wherein the stator flange element is arranged between the stator and the pump housing such that, in the fastened state of the lid, it fixes a stator end in a complementary stator holder of the connecting piece, wherein, when the lid is removed, the stator can be axially displaced so far out of the connecting piece in the direction of the pump housing that it disengages from the stator holder of the connecting piece.

4. The pump housing according to claim 2, wherein the ring segment-shaped axial guiding surface is bounded axially on the outside by a projection of the main housing body.

5. The pump housing according to claim 2, wherein a contact plane runs between the lid and the main housing body obliquely with respect to the longitudinal axis of the pump housing.

6. The pump housing according to claim 2, wherein a stator flange element coupled with the pump housing is axially displaceable on the ring segment-shaped axial guiding surface and the lid fastened to the main housing body prevents a displacement of the stator flange element in the direction of the drive-side opening.

7. The pump housing according to claim 6, wherein the main housing body limits the axial displaceability of the stator flange element in a direction away from the drive-side opening.

8. The pump housing according to claim 1, wherein the ring segment-shaped axial guiding surface is bounded axially on the outside by a projection of the main housing body.

9. The pump housing according to claim I, wherein a contact plane runs between the lid and the main housing body obliquely with respect to the longitudinal axis of the pump housing.

10. The pump housing according to claim I, wherein a stator flange element coupled with the pump housing is axially displaceable on the ring segment-shaped axial guiding surface and the lid fastened to the main housing body prevents a displacement of the stator flange element in the direction of the drive-side opening.

11. The pump housing according to claim 10, wherein the main housing body limits the axial displaceability of the stator flange element in a direction away from the drive-side opening.

12. The pump housing according to claim 3, wherein the lid includes a ring segment-shaped inner circumferential surface lying opposite the ring segment-shaped axial guiding surface, which the ring segment-shaped inner circumferential surface has the same distance radially from the longitudinal axis as the ring segment-shaped axial guiding surface and is bounded axially on the inside by a projection of the lid extending radially inwards.

13. The eccentric screw pump according to claim 12 wherein the stator, the rotor and the stator flange element form a subassembly.

14. The pump housing according to claim 12, wherein the ring segment-shaped axial guiding surface is bounded axially on the outside by a projection of the main housing body.

15. The pump housing according to claim 12, wherein a contact plane runs between the lid and the main housing body obliquely with respect to the longitudinal axis of the pump housing.

16. The pump housing according to claim wherein a stator flange element coupled with the pump housing is axially displaceable on the ring segment-shaped axial guiding surface and the lid fastened to the main housing body prevents a displacement of the stator flange element in the direction of the drive-side opening.

17. The pump housing according to claim 16, wherein the main housing body limits the axial displaceability of the stator flange element in a direction away from the drive-side opening.

18. The pump housing according to claim 8, wherein the ring segment-shaped axial guiding surface extends only in a region of the main housing body covered by the lid.

* * * * *